US012146292B2

(12) United States Patent
Rose

(10) Patent No.: US 12,146,292 B2
(45) Date of Patent: Nov. 19, 2024

(54) RECONFIGURABLE BOX BLADE

(71) Applicant: Hank Rose, Columbia, NC (US)

(72) Inventor: Hank Rose, Columbia, NC (US)

(73) Assignee: Rose Welding & Crane Service, Inc., Columbia, NC (US)

( * ) Notice: Subject to any disclaimer, the term of this patent is extended or adjusted under 35 U.S.C. 154(b) by 348 days.

(21) Appl. No.: 16/925,968

(22) Filed: Jul. 10, 2020

(65) Prior Publication Data

US 2021/0010232 A1 Jan. 14, 2021

Related U.S. Application Data

(60) Provisional application No. 62/878,547, filed on Jul. 25, 2019, provisional application No. 62/872,984, filed on Jul. 11, 2019.

(51) Int. Cl.

| | |
|---|---|
| ***E02F 9/00*** | (2006.01) |
| ***E02F 3/76*** | (2006.01) |
| ***E02F 3/815*** | (2006.01) |

(52) U.S. Cl.

CPC ..... *E02F 9/003* (2013.01); *E02F 3/7622* (2013.01); *E02F 3/815* (2013.01)

(58) Field of Classification Search

CPC ..... E02F 9/003; E02F 3/7622; E02F 3/815; E02F 3/7668; E02F 3/7672; E02F 3/7609; E02F 3/7631; E02F 3/7618; E01H 5/065

USPC ..... 172/811, 824, 825, 834

See application file for complete search history.

(56) References Cited

U.S. PATENT DOCUMENTS

| | | | | | |
|---|---|---|---|---|---|
| 315,184 | A * | 4/1885 | Taft | E02F 3/7668 | 172/784 |
| 1,021,047 | A * | 3/1912 | Jewett | E02F 3/7668 | 172/784 |
| 1,885,804 | A * | 11/1932 | Cundiff | E02F 3/7668 | 172/742 |
| 2,142,985 | A * | 1/1939 | Arndt | E02F 3/7668 | 172/477 |
| 2,177,864 | A * | 10/1939 | Cahall | E02F 3/7672 | 172/799.5 |
| 2,208,526 | A * | 7/1940 | Gurries | E02F 3/7672 | 172/507 |
| 2,718,719 | A * | 9/1955 | Anderson | E02F 3/815 | 172/675 |
| 2,816,375 | A * | 12/1957 | Anderson | E02F 3/815 | 172/811 |
| 3,049,820 | A * | 8/1962 | Lichti | E02F 3/7618 | 172/826 |

(Continued)

*Primary Examiner* — Edwin J Toledo-Duran

(74) *Attorney, Agent, or Firm* — Fish & Richardson P.C.

(57) ABSTRACT

A reconfigurable box blade includes a box frame that includes a left sidewall, a right sidewall, and a scraping blade that spans laterally between the left sidewall and the right sidewall. The reconfigurable box blade also includes a means for attaching the box frame to a vehicle. The reconfigurable box blade has a first configuration and a second configuration. The first configuration includes the scraping blade being in contact with a ground surface, and, a longest dimension of the box blade oriented substantially perpendicular to a longitudinal axis of the vehicle. The second configuration includes the scraping blade being out of contact with the ground surface and the longest dimension of the box frame being substantially aligned with the longitudinal axis of the vehicle.

28 Claims, 16 Drawing Sheets

(56) References Cited

U.S. PATENT DOCUMENTS 3,162,459 A * 12/1964 Lawson ..... A01B 73/067 280/43.23
3,373,822 A * 3/1968 Hornung ..... A01B 21/04 172/311
3,448,814 A * 6/1969 Jackson ..... A01B 49/027 172/170
3,452,828 A * 7/1969 Deli ..... E02F 3/7613 172/826
3,631,931 A * 1/1972 Frisbee ..... E02F 3/7613 172/484
3,661,214 A * 5/1972 Peterson ..... E02F 3/80 172/814
3,698,490 A * 10/1972 King ..... E02F 3/7618 172/824
3,776,318 A * 12/1973 Layton ..... E02F 3/7604 172/507
3,793,752 A * 2/1974 Snyder ..... E01H 5/063 37/234
3,901,329 A * 8/1975 Eftefield ..... E02F 3/7613 172/822
3,941,195 A * 3/1976 Stedman ..... E02F 3/7618 172/827
3,998,277 A * 12/1976 Wirt ..... E02F 3/7618 172/826
3,999,277 A * 12/1976 Hamada ..... F01L 1/047 74/567
4,026,368 A * 5/1977 Asal ..... E02F 3/7618 172/827
4,098,344 A * 7/1978 Johnson ..... E02F 3/80 172/170
4,106,795 A * 8/1978 Henning ..... A01B 59/048 172/834
4,135,584 A * 1/1979 Smith ..... E02F 3/7618 172/827
4,147,218 A * 4/1979 Stedman ..... E02F 3/7618 172/830
4,185,698 A * 1/1980 Frisbee ..... E02F 3/962 172/811
4,201,268 A * 5/1980 Frisbee ..... E02F 3/7613 172/812
4,253,529 A * 3/1981 Nissen ..... E02F 3/8157 172/818
4,270,617 A * 6/1981 Cantarella ..... E02F 3/844 172/825
4,286,672 A * 9/1981 Forsyth ..... A01B 73/02 172/383
4,405,019 A * 9/1983 Frisbee ..... E02F 3/7613 172/826
4,892,155 A * 1/1990 Wanamaker ..... E02F 3/3414 172/199
4,893,683 A * 1/1990 Horsch ..... E02F 3/80 172/824
5,165,191 A * 11/1992 Davis ..... E02F 3/7613 37/409
6,105,682 A * 8/2000 Recker ..... E02F 3/7618 172/811
6,273,198 B1 * 8/2001 Bauer ..... E02F 3/7613 172/825
6,425,196 B1 * 7/2002 Weagley ..... E02F 3/815 37/270
6,688,403 B2 * 2/2004 Bernhardt ..... A01B 69/004 701/50
6,827,155 B1 * 12/2004 Hoffart ..... A01B 59/044 172/824
7,008,168 B2 * 3/2006 Bernhardt ..... A01B 63/1006 91/531
7,740,084 B2 * 6/2010 Rosenboom ..... B60G 99/00 180/9.1
7,854,272 B2 * 12/2010 Friggstad ..... A01B 73/065 172/311
8,118,111 B2 * 2/2012 Armas ..... E02F 9/2207 172/779
8,342,256 B2 * 1/2013 Adams ..... A01B 73/065 172/311
8,657,024 B2 * 2/2014 Fraley ..... A01B 31/00 172/196
9,699,949 B2 * 7/2017 Lykken ..... A01B 73/00
10,323,382 B2 * 6/2019 Sharp ..... E02F 3/815
10,676,894 B2 * 6/2020 Sharp ..... E02F 3/7609
11,105,058 B2 * 8/2021 Holzapfel ..... E01H 4/02
2005/0246926 A1 * 11/2005 Verseef ..... E01H 5/066 37/281
2006/0090910 A1 * 5/2006 Houck ..... A01B 73/00 172/272
2008/0210446 A1 * 9/2008 Cherney ..... E02F 3/7618 172/812
2009/0032274 A1 * 2/2009 Pitonyak ..... A01B 73/044 16/386
2009/0119954 A1 * 5/2009 Lemieux ..... E02F 3/815 37/236
2011/0297405 A1 * 12/2011 Fraley ..... E02F 3/7622 172/684.5
2012/0279735 A1 * 11/2012 Ditzler ..... E02F 3/815 172/825
2015/0223385 A1 * 8/2015 Lykken ..... A01B 73/00 172/388
2015/0223387 A1 * 8/2015 Lykken ..... A01B 73/065 172/388
2015/0361639 A1 * 12/2015 Helmeczi ..... E02F 3/7672 172/684.5
2016/0108603 A1 * 4/2016 Hoyt ..... E02F 3/7613 172/663
2019/0194907 A1 * 6/2019 Sharp ..... E02F 3/962
2021/0079611 A1 * 3/2021 Saranzak ..... E01H 5/06
2022/0178099 A1 * 6/2022 Kushner ..... E02F 3/7668

* cited by examiner

RECONFIGURABLE BOX BLADE

RELATED APPLICATIONS

This application claims priority under 35 USC § 119(e) to provisional U.S. Patent Application 62/872,984, filed on Jul. 11, 2019, and provisional U.S. Patent Application 62/878,547, filed on Jul. 25, 2019, the entire contents of which is hereby incorporated by reference

BACKGROUND

This description relates to a box blade that can be reconfigured for various applications such as transportation or storage.

Box blades are earth working implements commonly used for grading or screeding the earth. A box blade implement typically includes left and right sidewalls and an earth screeding blade (sometimes referred to as a scraping blade) that spans laterally between such walls. Box blades have been known to be mounted or otherwise connected to vehicles such as tractors, front end loaders, skid steer loader vehicles, etc. for grading and screeding operations.

Due to the large size and weight of box blades, it can be challenging to store box blades or to transport box blades from one location to another, especially over long distances. Although some box blades are outfitted with wheels, transporting box blades can still pose a significant challenge since box blades can sometimes have a width greater than that of the vehicle to which they are connected. In such circumstances, the box blade may inhibit a user from driving the vehicle on narrow roads without first disconnecting the box blade.

SUMMARY

The apparatus, systems, and techniques described herein can aid individuals with the transportation and storage of box blades. A reconfigurable box blade may enable easier transportation and storage by raising the box blade from the ground and rotating the box blade such that a longest dimension of the box blade is substantially aligned with the longitudinal axis of a vehicle to which the box blade is connected. Such a configuration may prevent the box blade from being dragged along the ground during transportation and may enable a vehicle connected to the box blade safely drive on roads, for example, without exceeding the width of a typical driving lane.

In general, in an aspect, a reconfigurable box blade includes a box frame that includes a left sidewall, a right sidewall, and a scraping blade that spans laterally between the left sidewall and the right sidewall. The reconfigurable box blade also includes a means for attaching the box frame to a vehicle. The reconfigurable box blade has a deployed configuration and a stowed configuration. The deployed configuration includes the scraping blade being in contact with a ground surface, and a first dimension of the box frame being oriented substantially perpendicular to a longitudinal axis of the vehicle. The stowed configuration includes the scraping blade being above the ground surface such that the scraping blade is out of contact with the ground surface, and the first dimension of the box frame being substantially aligned with the longitudinal axis of the vehicle.

Implementations may include one or a combination of two or more of the following features. The first dimension of the box frame may be a longest dimension of the box frame. The connecting structure configured to attach the box frame to the vehicle may include a forwardly extending towing tongue. The connecting structure configured to attach the box frame may include a mount configured to interface with one or more three point hitch arms of the vehicle. One or more devices configured to loosen soil may be mounted to the box frame. The reconfigurable box blade may include one or more devices, such as a laser and a laser receiver, configured to collect data indicative of a grading operation of the box blade. The reconfigurable box blade may include one or more wheels. The one or more wheels may be disposed along at least two wheel axes, the at least two wheel axes being offset from each other. The deployed configuration may include a subset of the one or more wheels being out of contact with a ground surface and the stowed configuration may include the subset of the one or more wheels being in contact with the ground surface. A wheel axis of at least a portion of the one or more wheels may be configured to move relative to the box frame. The reconfigurable box blade may include a linear motion actuator configured to move the wheel axis. The box frame may be configured to be raised and lowered relative to a ground surface. Raising the box frame relative to the ground surface may include rotating the box frame beyond 90 degrees relative to the ground surface. The reconfigurable box blade may include a linear motion actuator configured to raise the box frame. Subsequent to being raised relative to the ground surface, the box frame may be configured to be rotated about a rotation axis oriented perpendicular to the ground surface. The reconfigurable box blade may include one or more gears and a chain drive configured to rotate the box frame. Reconfiguring the box blade from the deployed configuration to the stowed configuration may include moving, relative to the box frame, a wheel axis of one or more wheels of the box blade, raising the box frame relative to the ground surface, and rotating the box frame about a rotation axis oriented perpendicular to the ground surface. The reconfigurable box blade may include a stopping component mounted to the connecting structure, the stopping component configured to secure the box blade in the stowed configuration. The stopping component may include a latch configured to be secured over a portion of the box frame.

In general, in an aspect, a method for reconfiguring a box blade attached to a vehicle from a first configuration to a second configuration is disclosed. The first configuration includes a first dimension of the box frame being oriented substantially perpendicular to a longitudinal axis of the vehicle. The second configuration includes the first dimension of the box frame being substantially aligned along the longitudinal axis of the vehicle. The method includes raising, relative to the ground surface, a box frame of the reconfigurable box blade, the box frame including a left sidewall, a right sidewall, and a scraping blade that spans laterally between the left sidewall and the right sidewall, and rotating the box frame about a rotation axis oriented perpendicular to the ground surface.

In general, in an aspect, a method of reconfiguring a box blade attached to a vehicle includes from a first configuration, raising, relative to the ground surface, a box frame of the reconfigurable box blade, the box frame comprising a left sidewall, a right sidewall, and a scraping blade that spans laterally between the left sidewall and the right sidewall, wherein the first configuration comprises a first dimension of the box frame being oriented substantially perpendicular to a longitudinal axis of the vehicle and rotating the box frame about a rotation axis oriented perpendicular to the ground surface into a second configuration, the second configuration comprising the first dimension of the box frame being substantially aligned along the longitudinal axis of the vehicle.

Implementations may include one or a combination of two or more of the following features. Raising the box frame relative to the ground surface may include moving, relative to the box frame, a wheel axis of one or more wheels of the box blade. The wheel axis may be moved such that the one or more wheels of the box blade contacts the ground surface and the scraping blade is raised above the ground surface such that the scraping blade is out of contact with the ground. The wheel axis may be moved by a linear motion actuator. Raising the box frame relative to the ground surface may include rotating the box frame beyond 90 degrees relative to the ground surface. The box frame may be raised by a linear motion actuator. The box frame may be rotated by a rotation mechanism comprising one or more gears and a chain drive. The method of reconfiguring the box blade may include stopping rotation of the box frame when the box frame comes in contact with a stopping component of the box blade. The method of reconfiguring the box blade may include securing the box blade in the second configuration using a latch, the latch configured to be secured over a portion of the box frame.

In general, in an aspect, a reconfigurable box blade includes a box frame that includes a left sidewall, a right sidewall having at least one length equivalent to at least one length of the left sidewall, and a scraping blade that spans laterally between the left sidewall and the right sidewall. The reconfigurable box blade may also include one or more wheels. The one or more wheels may be above a ground surface when the reconfigurable box blade is in a stowed configuration, and in contact the with the ground surface when the reconfigurable box blade is in a deployed configuration. The reconfigurable box blade may also include a connecting structure configured to attach the box frame to a vehicle and a stopping component mounted to the connecting structure, the stopping component configured to secure the box blade in the stowed configuration, the stopping component comprising a latch configured to be secured over a portion of the box frame. A first dimension of the box frame is oriented substantially perpendicular to a longitudinal axis of the vehicle when the reconfigurable box blade is in the deployed configuration. The first dimension of the box frame is substantially aligned with the longitudinal axis of the vehicle when the reconfigurable box blade is in the stowed configuration. The box frame is rotated beyond 90 degrees about a rotation axis oriented parallel to the ground surface and rotated about a rotation axis perpendicular to the ground surface to move the box frame from the deployed configuration to the stowed configuration.

Implementations may include one or a combination of two or more of the following features. The first dimension of the box frame may be at least 20 feet. A flat surface of the stopping component may contact a flat surface of the box frame when the box frame is rotated beyond 90 degrees about the rotation axis oriented parallel to the ground surface and the box frame is rotated about the rotation axis perpendicular to the ground surface to move the box frame into the stowed configuration.

These and other aspects, features, and various combinations may be expressed as apparatuses, systems, methods, means for performing functions, etc.

Other features and advantages will be apparent from the description and the claims.

DETAILED DESCRIPTION

Figure 1:
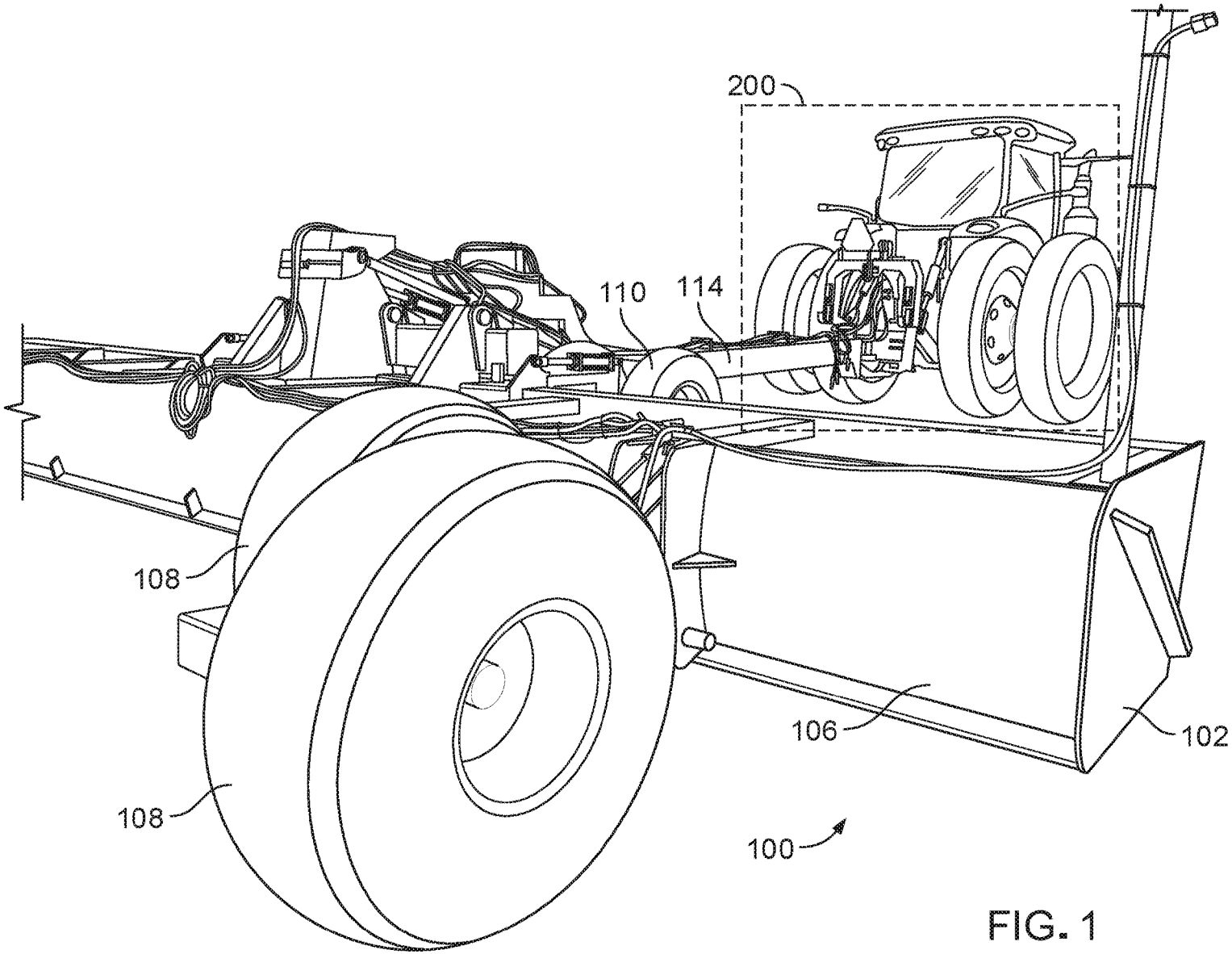
FIG. 1 is a rear perspective view of a box blade connected to a tractor.

In the field of earthworks, box blades are often used for earth grading or earth screeding operations. Box blades are earth working implements that typically include left and right sidewalls and an earth screeding blade (sometimes referred to as a scraping blade) that spans laterally between such walls. Box blades have been known to be mounted or otherwise connected to vehicles such as tractors, front end loaders, skid steer loader vehicles, etc. for grading and screeding operations.

Due to the large size and weight of box blades, it can be challenging to store conventional box blades or to transport conventional box blades from one location to another, especially over long distances. Although some box blades are outfitted with wheels, transporting box blades can still pose a significant challenge since box blades can sometimes have a width greater than that of the vehicle to which they are connected. In such circumstances, the box blade may inhibit a user from driving the vehicle on narrow roads without first disconnecting the box blade.

Here, we describe, among other things, a box blade that can be reconfigured into various configurations while connected to a vehicle. For example, the reconfigurable box blade can have multiple degrees of freedom and actuators that enable the box blade to assume multiple configurations such as an operating configuration, a transportation configuration, and various intermediate configurations.

We use the term "operating configuration" broadly to include, for example, any configuration of a box blade in which a portion of the scraping blade makes contact with the ground such that dragging the box blade horizontally along the ground would perform, for example, an earth grading operation.

We use the term "transportation configuration" broadly to include, for example, any configuration of a box blade that may be assumed for transporting the box blade from one location to another. Certain transportation configurations may have advantages over other transportation configurations. In some cases, assuming a transportation configuration may entail lifting the box blade such that the scraping blade does not make contact with the ground. In some cases, assuming a transportation configuration may entail rotating the box blade such that it does not exceed the width of a typical driving lane while being pulled by a connected vehicle. While the term "transportation configuration" is used herein, in some cases, the box blade configurations described in this application are not limited to transportation applications, and in some cases, may have advantages for other applications such as storage.

We use the term "intermediate configuration" broadly to include, for example, any configuration of the box blade that may be assumed throughout the process of reconfiguring the box blade from, for example, an operating configuration to a transportation configuration or vice versa.

The technology described herein may provide the following advantages. A reconfigurable box blade may enable transportation of the box blade from one location to another, for example, by roadways, without requiring detachment of the box blade from a connected vehicle. In some cases, a reconfigurable box blade may save time and energy costs of a user seeking to transport the box blade. In some cases, a reconfigurable box blade may enable more efficient storage and/or enable the box blade to fit into areas, such as the interior of a shed or a barn, which may be inaccessible to conventional box blades.

FIG. 1 illustrates a rear perspective view of an example box blade 100 connected to a tractor 200. The box blade 100 includes a body comprising a partially enclosed rigid box frame formed by a right sidewall 102, a left sidewall (104 in FIG. 5A), and a scraping blade 106 that spans laterally between the left and right sidewalls. The box blade 100 is pulled by a forwardly extending towing tongue 114 behind the tractor 200. In some cases, the forwardly extending towing tongue 114 is connected to the tractor 200 by engaging the tractor's rear end tow hitch. In some cases, other connections to the tractor 200 may be implemented. For example, a box blade may be mounted to the rear of a tractor upon the tractor's three point hitch arms. In some cases, a box blade may instead be adapted to connect to other vehicles, such as by attaching to the lift arms of a front end loader or skid steer loader vehicle.

The example box blade 100 further includes rear wheels 108 and front wheels 110, which may assist in relocating the box blade 100 without performing earth grading operations. In FIG. 1, the front wheels 110 are shown in a raised position and do not make contact with the ground. In this configuration, referred to herein as an "operating configuration" of the blade box 100, the scraping blade 106 of the blade box 100 is in contact with the ground and performs earth grading operations when pulled horizontally along the ground. In some implementations, the front wheels 110 can be lowered to make contact with the ground, and in some cases, lift the scraping blade 106 off of the ground such that the blade box 100 is above the ground surface and can be relocated without performing earth grading operations or causing unnecessary wear to the scraping blade 106. In some cases, the rear wheels 106 may have a larger diameter than the front wheels 110. While blade box 100 is shown having both rear wheels 108 and front wheels 110, in some cases, box blades are known to have only rear wheels 108, only front wheels 110, or no wheels at all. Furthermore, various implementations of box blades may include any number of rear or front wheels.

While box blade 100 is an example implementation of a box blade, it is not intended to be limiting, and there are many box blade variations that may be implemented. In some cases, the scraping blade 106 is made of steel and/or may be supplemented by removable and replaceable high carbon steel cutter plates that can be attached in a lateral series along the lower edge of the scraping blade. In some cases, the right sidewall 102 and the left sidewall 104 may each comprise an upper segment and a lower segment, such that the lower segments of the right and left sidewalls may be raised or lowered either independently or jointly (e.g., by linear action hydraulic cylinders). In some cases, this may enable a box blade to adjust the height of the bottom of the scraping blade 106 or enable adjustment to the angle or lateral tilt of the scraping blade 106 with respect to the level of a ground surface to be graded. In some cases, the lower segments of the right and left sidewalls may include a rotational degree of freedom (e.g., as provided by pivot facilitating pivoting pin, eye and clevis joints) such that the lower segments are able to pitch upwardly and downwardly to traverse obstructions such as rocks, etc. In some cases, the right sidewall 102 and the left sidewall 104 may respectively have attached left and right skid plates which extend in the front to rear or longitudinal direction along such walls' lower edges.

In some implementations, box blade 100 may include rippers that extend forwardly at the front of the box blade and work in combination with the scraping blade 106. In such implementations, the rippers may loosen compact soil while the scraping blade 106 scrapes and smooths the loosened soil. In some cases, the rippers are attached to a fixed beam that extends laterally between the right sidewall 102 and the left sidewall 104 of the box blade 100. In some cases, the beam containing the rippers is rotatable such that the rippers may be rotated up, or stowed, so that they cannot contact the soil. In some cases, each ripper is individually mounted and rotatable relative to the box blade 100. In some cases, the rippers are designed to be replaceable.

Figure 2:
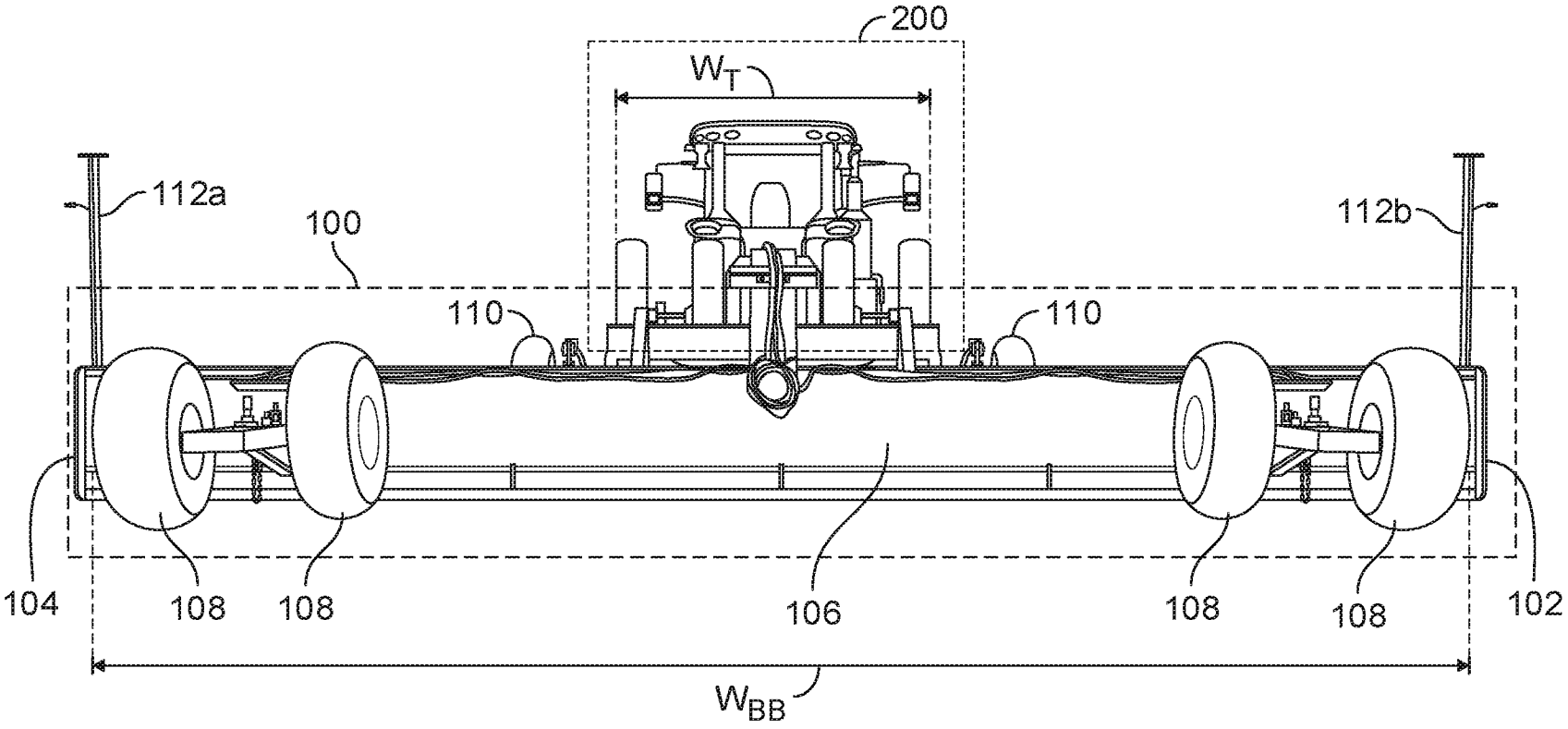
FIG. 2 is a rear view of a box blade connected to a tractor.

FIG. 2 illustrates a rear view of the box blade 100 connected to the tractor 200. As shown in this view, the box blade 100 includes two posts 112*a*, 112*b* (referred to collectively as posts 112), mounted to the left sidewall 104 and right sidewall 102 respectively. In some cases, the posts 112 may be use to mount lasers and/or laser receivers, which may provide feedback on the grading operations of the box blade 100. In some cases, the feedback from the laser receivers mounted on the posts 112 can be used to automatically make adjustments to the box blade 100, such as altering a lateral tilt of the scraping blade 106.

Referring still to FIG. 2, the lateral width, $W_{BB}$, of the box blade 100 is shown in relation to the width, $W_T$, of the tractor 200. The width of the box blade 100 is much larger than the width of the tractor 200 (in this example, $W_{BB}>3*W_T$). For example, box blade widths may be larger than 15 feet, 20 feet, 40 feet, etc. This disparity in width can pose significant challenges for transporting the box blade 100 on roads where the width of the box blade $W_{BB}$ exceeds the width of the driving lane. Consequently, it is desirable to design box blade 100 such that it can be reconfigured to a transportation configuration that mitigates this challenge.

Figure 3:
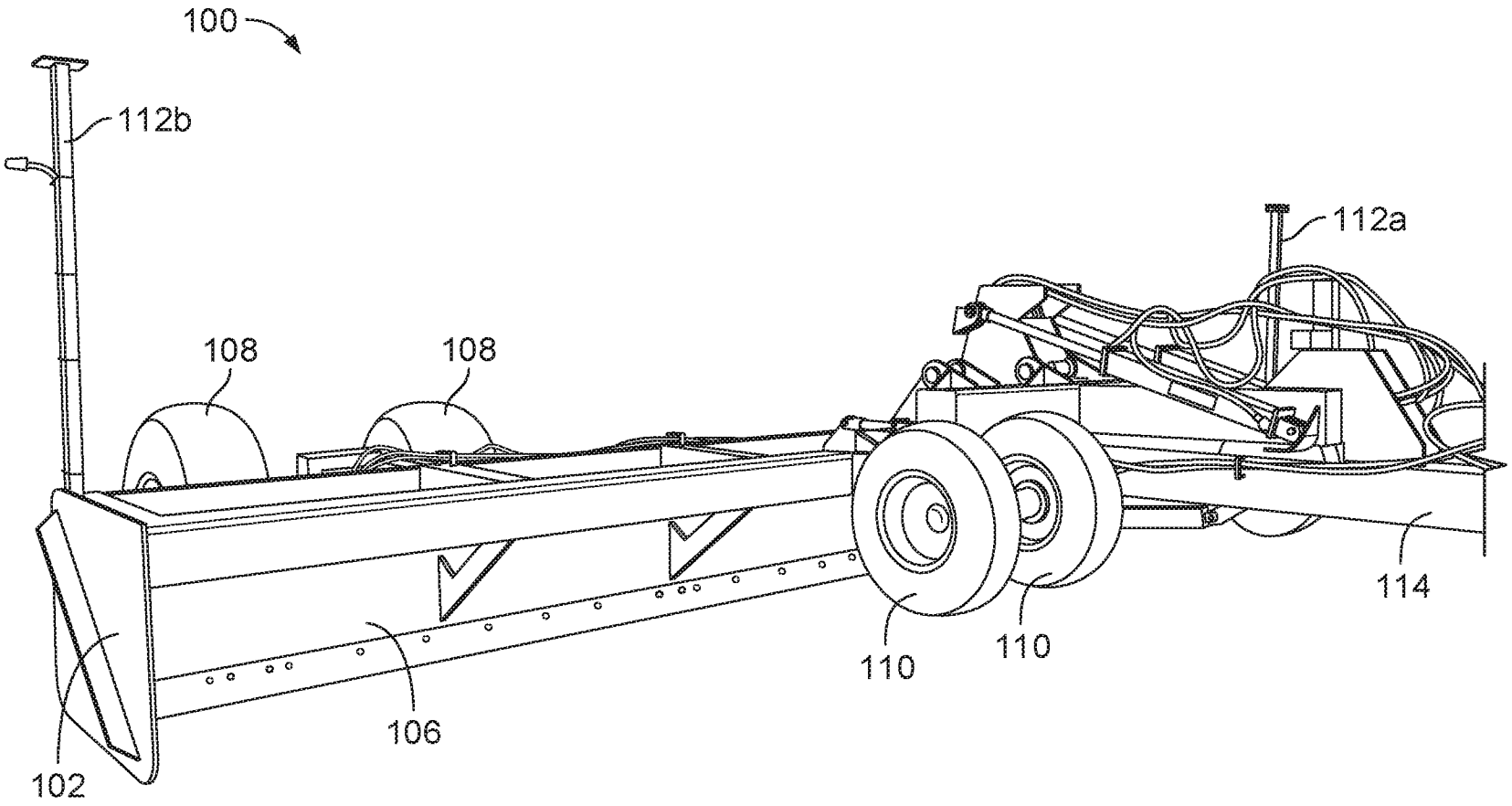
FIG. 3 is a front perspective view of a box blade.
Figure 4:
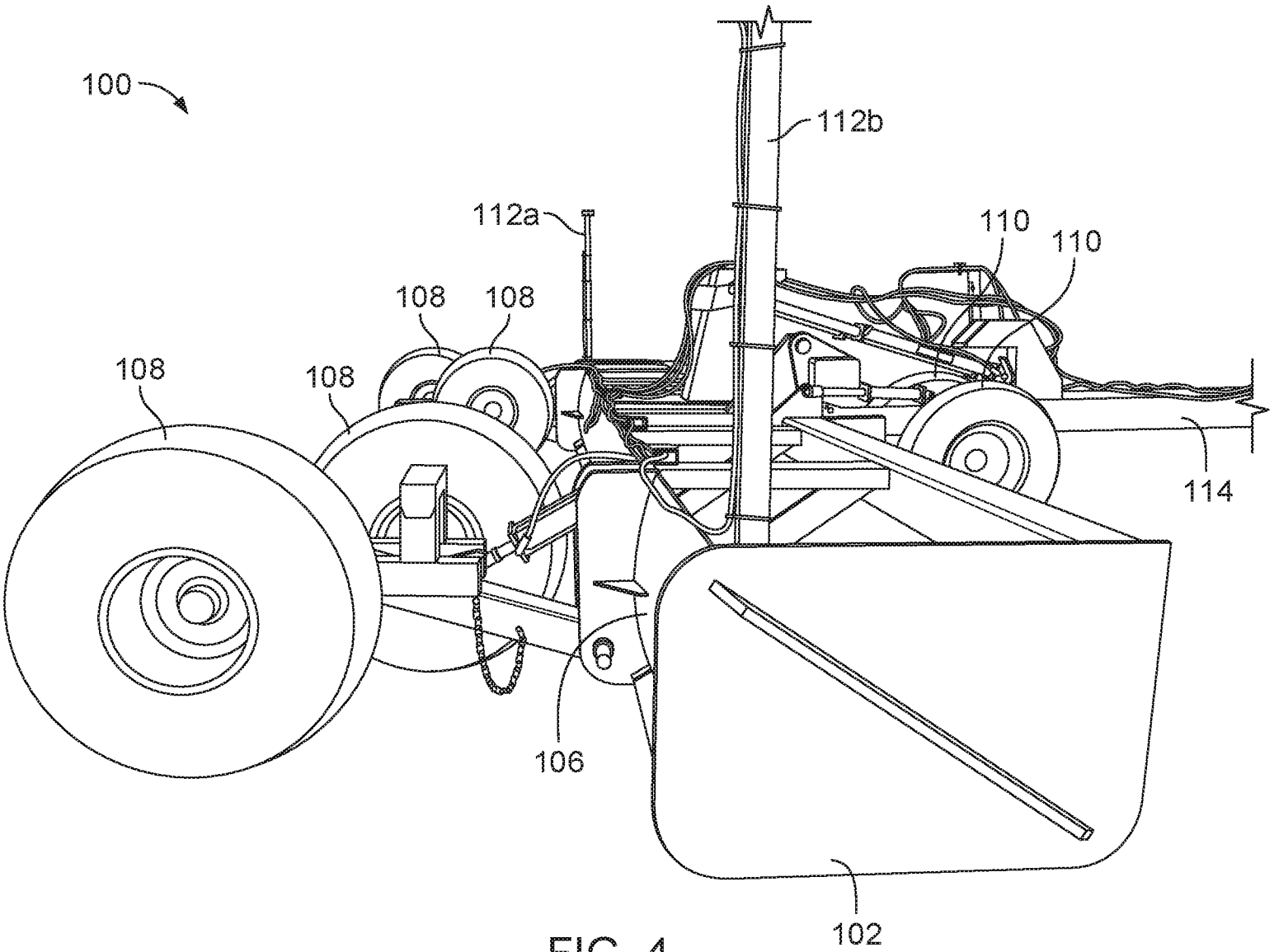
FIG. 4 is a right side view of a box blade.

FIGS. 3 and 4 illustrate a front perspective view and a right side view, respectively, of the box blade 100 in an operating configuration, presenting alternative views of the components previously described above.

Figure 5A:
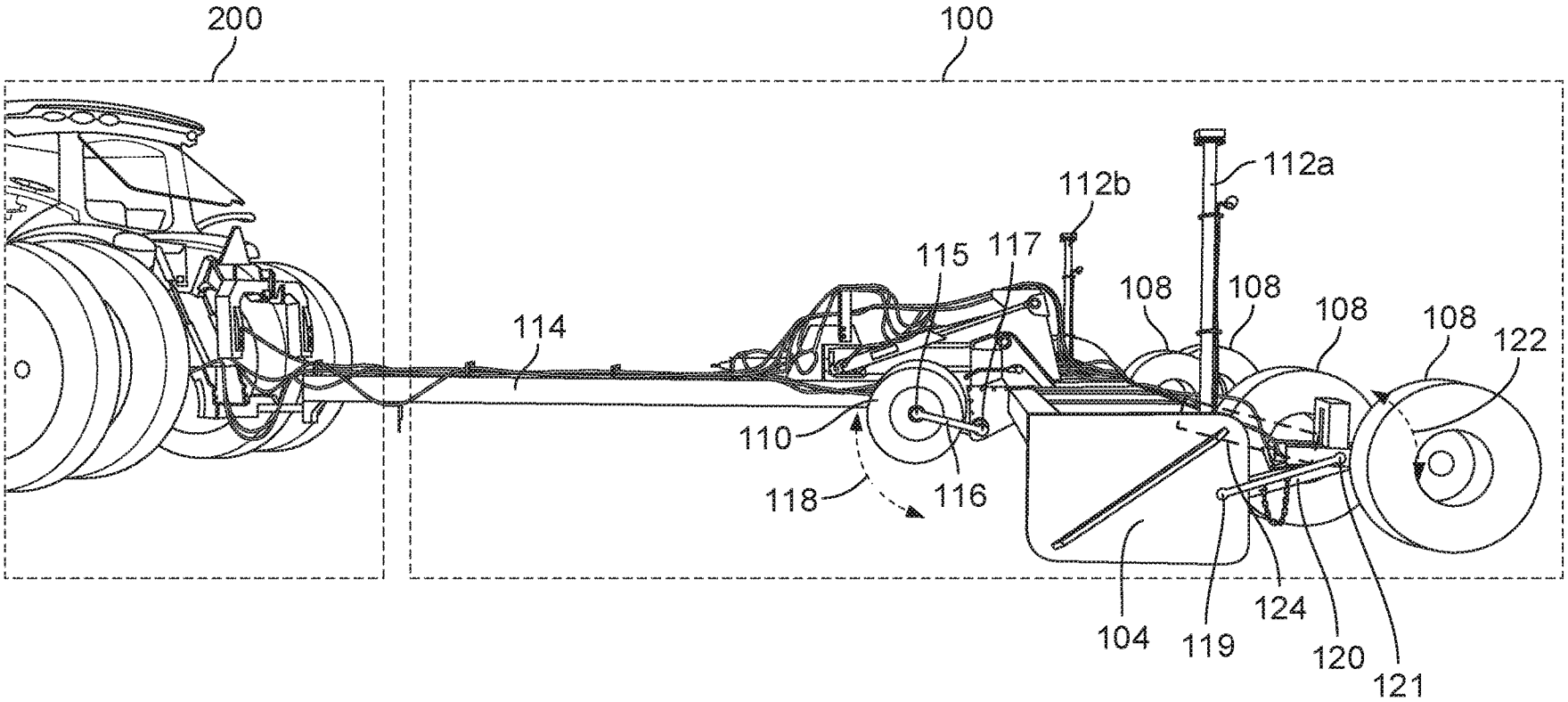
FIG. 5A is a left side view of a box blade connected to a tractor in an operating configuration.

FIG. 5A shows a left side view of the box blade 100 connected to the tractor 200 in an operating configuration. That is, the front wheels 110 of the box blade 100 are raised such that the scraping blade 106 is in contact with the ground and performs earth grading operations when the box blade 100 is pulled horizontally along the ground. In addition to the components already described, FIG. 5A illustrates example degrees of freedom that may be implemented in the reconfigurable box blade 100. One degree of freedom is shown by directional arrow 118, indicating a motion that can be performed by the front wheels 110. In some cases, the motion 118 can be achieved by using a bar 116 to connect a point on the front wheel axis 115 to a point on a pivot axis 117 that runs through the body of the box blade 100. In some cases, the motion 118 can be selectively controlled by a linear motion actuator such as a linear hydraulic actuator, a linear pneumatic actuator, etc. In some cases, the motion 118 can be selectively controlled by a motor that delivers torque about the pivot axis 117.

Another degree of freedom is shown by directional arrow 122, indicating the motion that can be performed by the rear wheels 108. In some cases, the motion 122 can be achieved by using a bar 120 to connect a point on the rear wheel axis 121 to a pivot axis 119 that runs through the body of the box blade 100. In some cases, the motion 120 can be selectively controlled by a linear motion actuator such as actuator 124. In some cases, the actuator 124 may be a linear hydraulic actuator, a linear pneumatic actuator, etc.

Figure 5B:
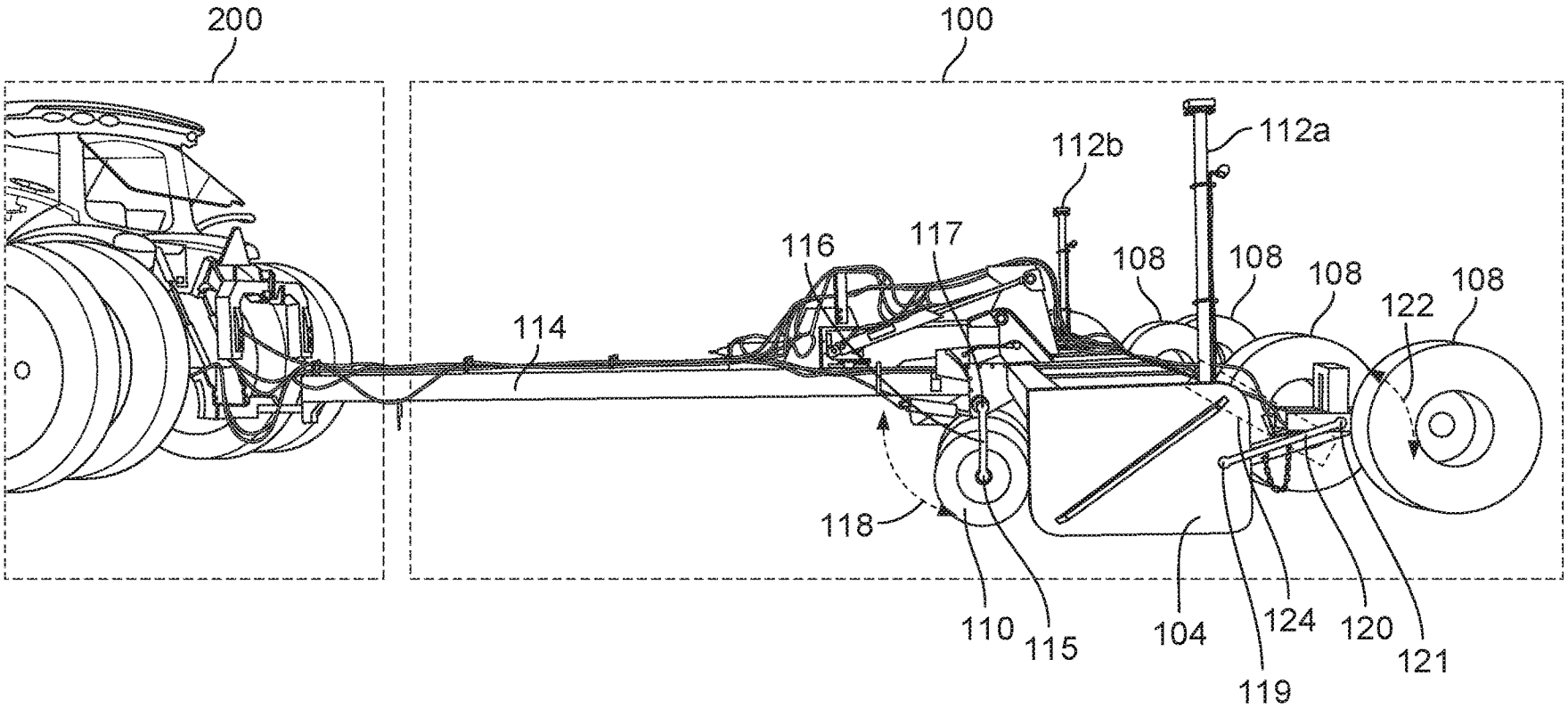
FIGS. 5B-5E are left side views of a box blade connected to a tractor in various intermediate configurations.

FIG. 5B shows a left side view of the box blade 100 connected to the tractor 200 in an intermediate configuration. In this intermediate configuration, the front wheels 110 have been lowered by moving the front wheels 110 along the motion path 118, for example, by rotating the bar 116 about the pivot axis 117. In this example, lowering the front wheels 110 causes the front wheels 110 to make contact with the ground and lifts the body of the box blade 100 and the rear wheels 108 so that they do not make contact with the ground. In this intermediate configuration, the rear wheels have also been moved. In particular, the rear wheels have been moved along motion path 122 by extending the linear motion actuator 124 to rotate the bar 120 about the pivot axis 119.

Figure 5C:
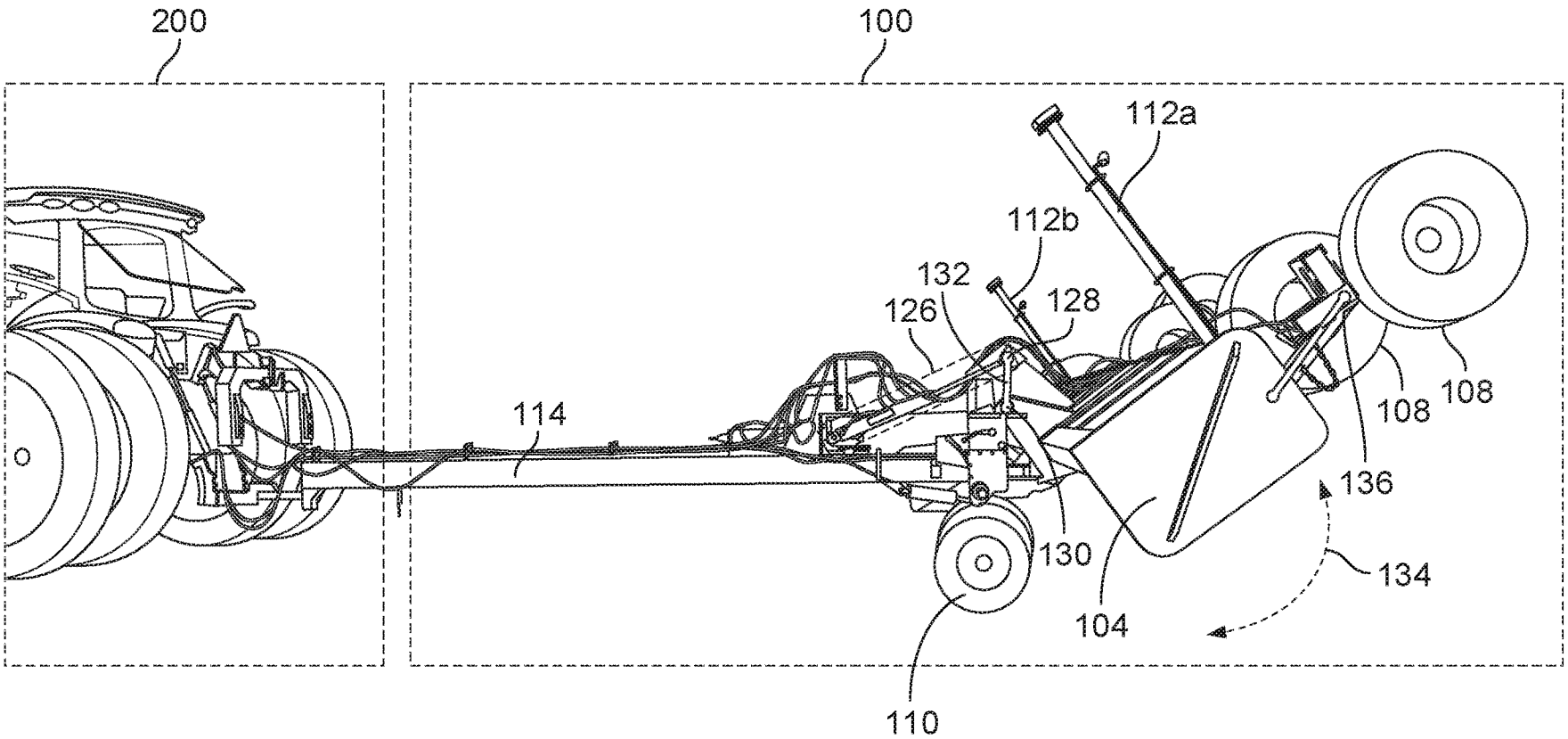

FIG. 5C shows a left side view of the box blade 100 connected to the tractor 200 in another intermediate configuration. Compared to the intermediate configuration shown in FIG. 5B, the box blade 100 has been reconfigured by moving the body of the box blade along motion path 134. In this example, the motion 134 is achieved by using a bar 132 to connect a point on an axis 128 to a point on a pivot axis 130 that runs through the body of the box blade 100. In some cases, the motion 134 can be selectively controlled by a linear motion actuator such as actuator 126. In some cases, the actuator 126 may be a linear hydraulic actuator, a linear pneumatic actuator, etc. In this example, the actuator 126 is connected to a point on the axis 128 such that when the actuator 126 is shortened, the bar 132 rotates about the pivot axis 130, causing the body of the box blade to be lifted away from the ground along motion path 134. In some implementations, when the actuator 126 is lengthened, the bar 132 rotates about the pivot axis in an opposite direction, causing the body of the box blade to be lowered to the ground along motion path 134.

Figure 5D:
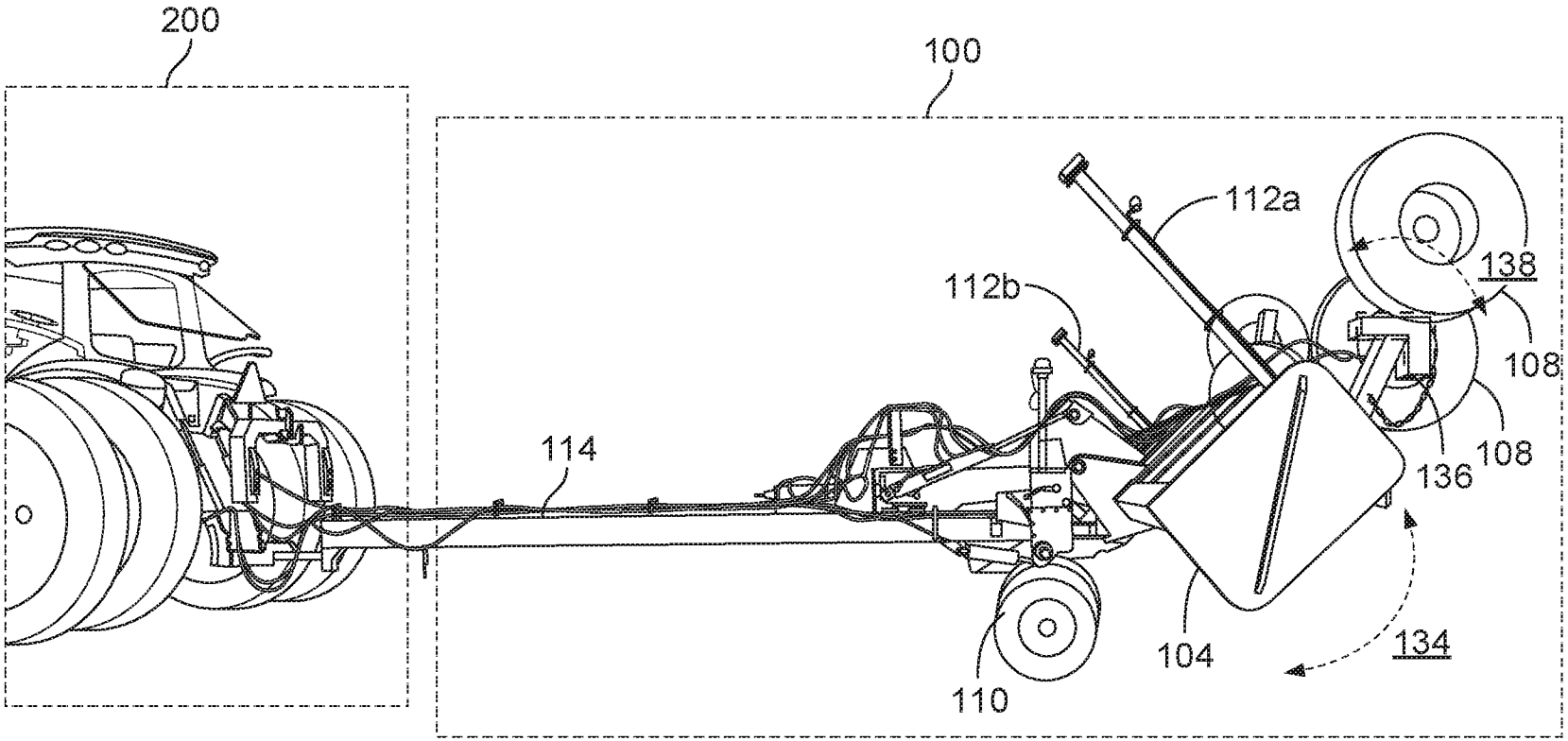

FIG. 5D shows a left side view of the box blade 100 connected to the tractor 200 in another intermediate configuration. Compared to the intermediate configuration shown in FIG. 5C, the box blade 100 has been reconfigured via rotation of the rear wheels 108 relative to the body of the box blade along the motion path 138. In some cases, the rear wheels 108 of the box blade 100 are offset such that the wheel axis of at least two of the rear wheels 108 are not aligned. In such scenarios, as the body of the box blade 100 is lifted away from the ground along motion path 134 (as described in reference to FIG. 5C), the weight distribution of the offset rear wheels 108 can cause a rear wheel assembly (including rear wheels 108 and rear wheel bracket 136) to rotate relative to the body of the box blade due to gravitational force. This rotation of the rear wheel assembly relative to the body of the box blade is shown most clearly by the relative positioning of the rear wheel bracket 136 in FIGS. 5D and 5E. In some cases, the rotation of the rear wheel assembly relative to the body of the box blade may occur when the box blade has been lifted to form an angle of approximately 30 degrees to 50 degrees with the ground surface and in some cases, the amount of rotation of the rear wheel assembly is limited by the shape and size of the rear wheel bracket 136. In some implementations, the rotation of the rear wheel assembly as the body of the box blade is raised and lowered can provide advantages to the stability of the box blade 100 in its intermediate configurations.

Figure 5E:
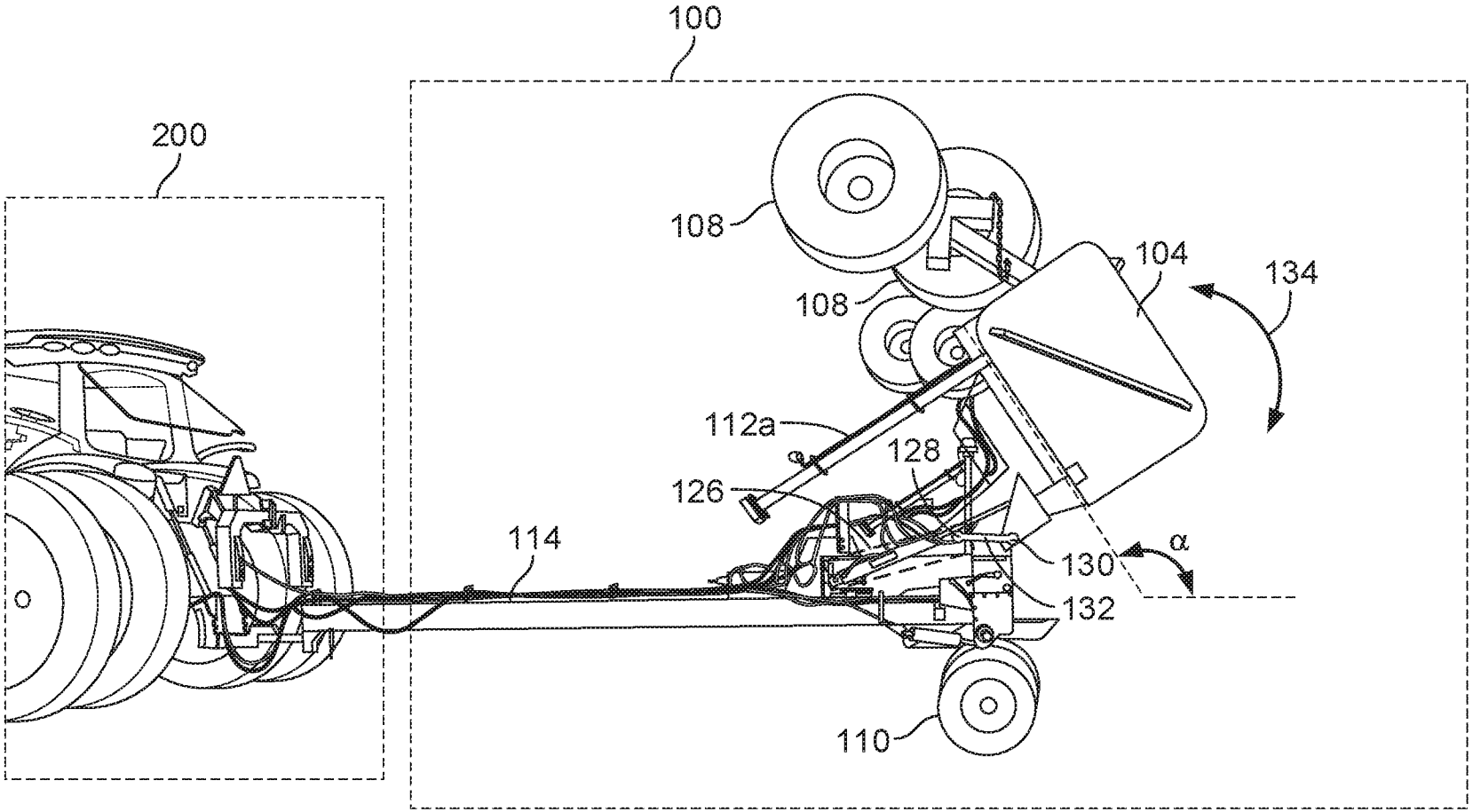

FIG. 5E shows a left side view of the box blade 100 connected to the tractor 200 in yet another intermediate configuration. Compared to the intermediate configuration shown in FIG. 5D, the box blade 100 has been reconfigured via continued motion of the body of the box blade along motion path 134 (as described in relation to FIG. 5C) until the actuator 126 has been fully retracted. In other words, FIG. 5E illustrates the body of the box blade in the position of its maximum rotation along the motion path 134 as enabled by the reconfigurable box blade 100. The degree of rotation of the body of the box blade is shown by angle $\alpha$. In some cases, in the position of maximum rotation along the motion path 134, the angle $\alpha$ may have a value between 90 degrees and 150 degrees. In some cases, rotating the body of the box blade within this range may maximize stability of the box blade 100 in this intermediate configuration.

Figure 5F:
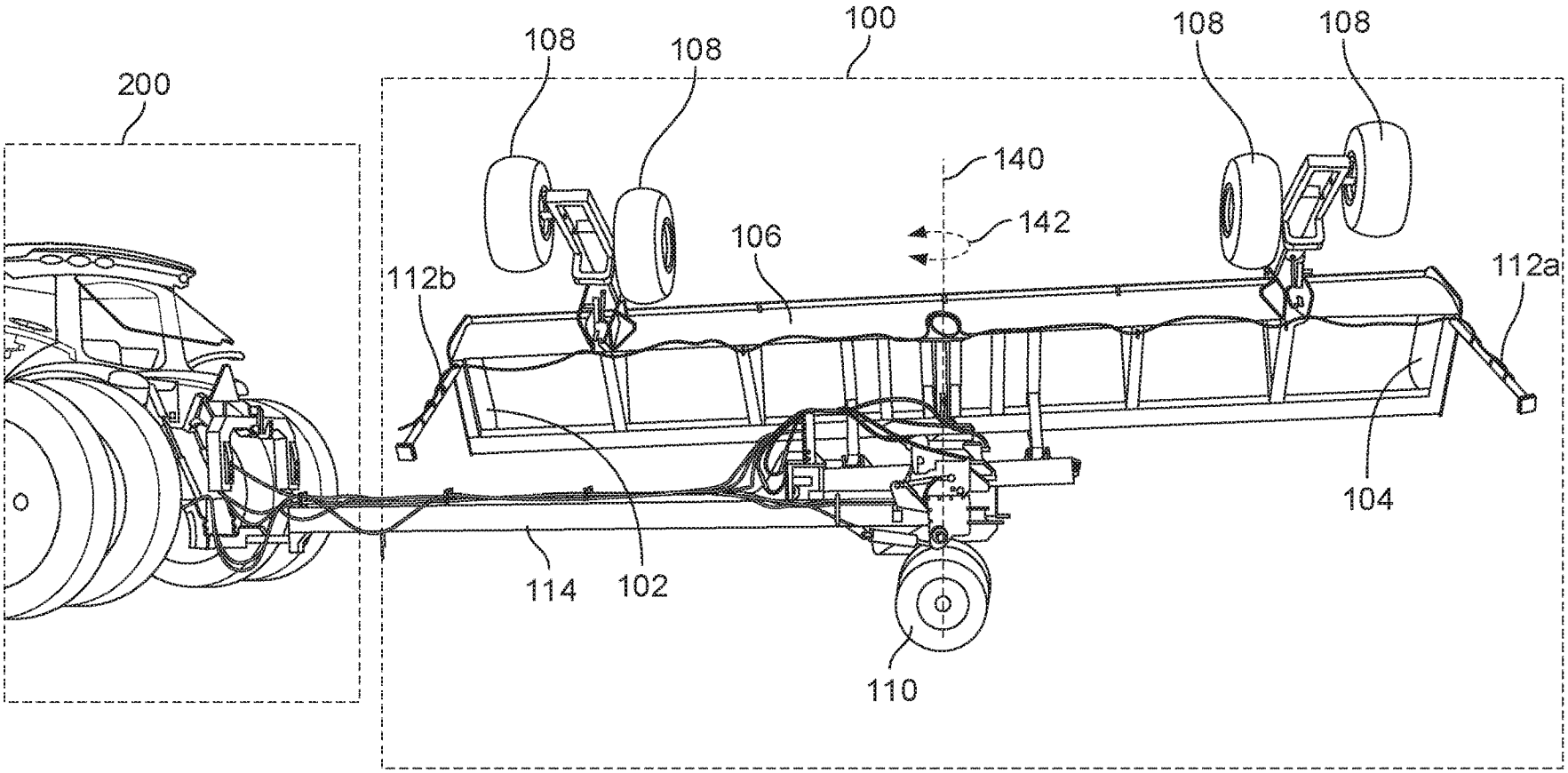
FIG. 5F is a left side view of a box blade connected to a tractor in a transportation configuration.

FIG. 5F shows a left side view of the box blade 100 connected to the tractor 200 in a transportation configuration. Compared to the intermediate configuration shown in FIG. 5E, the box blade 100 has been reconfigured via moving the body of the box blade along motion path 142 by rotating about axis 140. The axis 140 is oriented normal to the ground surface, and in some implementations, the axis 140 is positioned to intersect the wheel axis of the front wheels 110. In some cases, the transportation configuration is achieved when the longest dimension of the box blade, $W_{BB}$, is substantially aligned with the forwardly extending towing tongue 114 or the longitudinal axis of the connected tractor 200. In some cases, this may correspond to an angle of rotation of approximately 90 degrees about the axis 140. While FIG. 5E illustrates a transportation configuration of the box blade 100 in which the rear wheels 108 are located toward the left side of the tractor 200, in some cases, the direction of rotation about the axis 140 may be reversed such that the transportation configuration of the box blade 100 has the rear wheels 108 located toward the right side of the tractor 200.

The mechanism by which motion 142 is controlled can be referred to as a rotation mechanism. In some cases, the motion 142 can be selectively controlled by a rotation mechanism that comprises a linear motion actuator such as a linear hydraulic actuator, a linear pneumatic actuator, etc. In some cases, the motion 142 can be selectively controlled by a rotation mechanism that includes one or more motors that deliver torque about the axis 140. For example, FIGS. 8A and 8B, depict an implementation of a rotation mechanism for the box blade 100, wherein the box blade has assumed a transportation configuration corresponding to the transportation configuration shown in FIG. 5F.

Figure 8A:
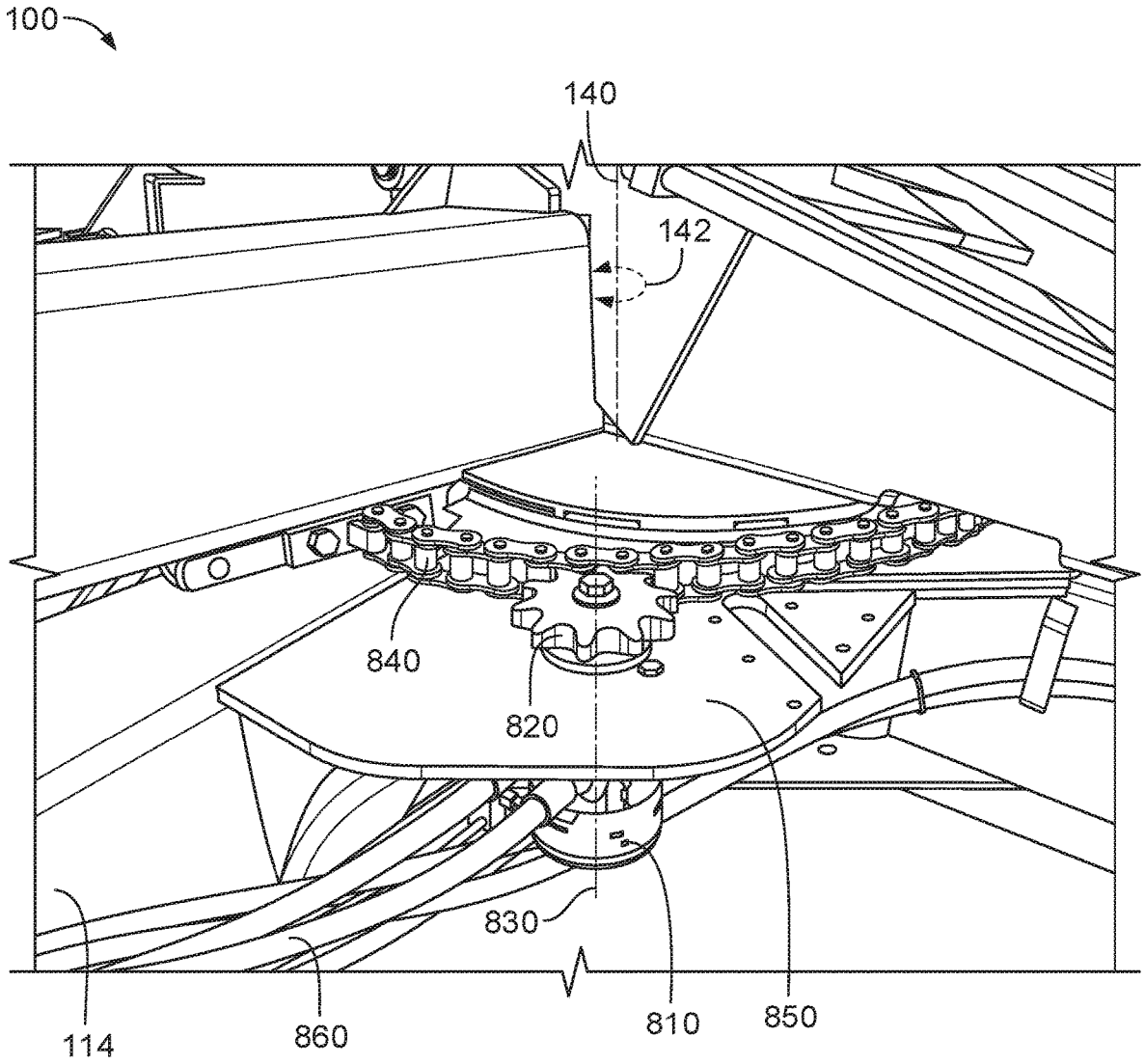
FIG. 8A is a front perspective view of a rotation mechanism of a box blade.

FIG. 8A is a front perspective view of the rotation mechanism for the box blade 100. The rotation mechanism includes a motor 810, a gear 820, and a chain drive 840. The motor 810 and the gear 820 are mounted to a bracket 850 connected to the forwardly extending towing tongue 114. The motor 810 and the gear 820 can be aligned along axis 830 so that the rotation of the motor 810 drives rotation of the gear 820. The teeth of the gear 820 are configured to interface with a chain drive 840 such that rotation of the gear 820 causes the chain drive to 840 to move relative to the gear 820. The chain drive 840 can be disposed in a fixed orientation relative to the body of the box blade 100 so that movement of the chain drive 840 causes the body of the box blade 100 to rotate relative to the forwardly extending towing tongue 114. In some implementations, the chain drive 840 can be configured to move about a center of rotation that is aligned with the axis 140. In this way, the chain drive 840 can transmit mechanical power from axis 130 to axis 140 in order to move the box blade 100 along the motion path 142.

In some implementations the gear 820 is mounted one side of the bracket 850 while the motor is mounted on an opposite side of the bracket 850. For example, in FIG. 8A, the gear is disposed on a top surface of the bracket 850 while the motor is disposed on a bottom surface of the bracket 850. In this implementation, the cables 860 that deliver power and/or control signals to the motor 830 run below the bracket 850 and connect to the motor 830 at a location below the bracket 850. As a results, the cables 860 are physically separated from moving components such as the gear 820, the chain drive 840, and the rotating body of the box blade 100. This may provide advantages for preventing entanglement of the cables 860 or damage to one or more components of the box blade 100.

Figure 8B:
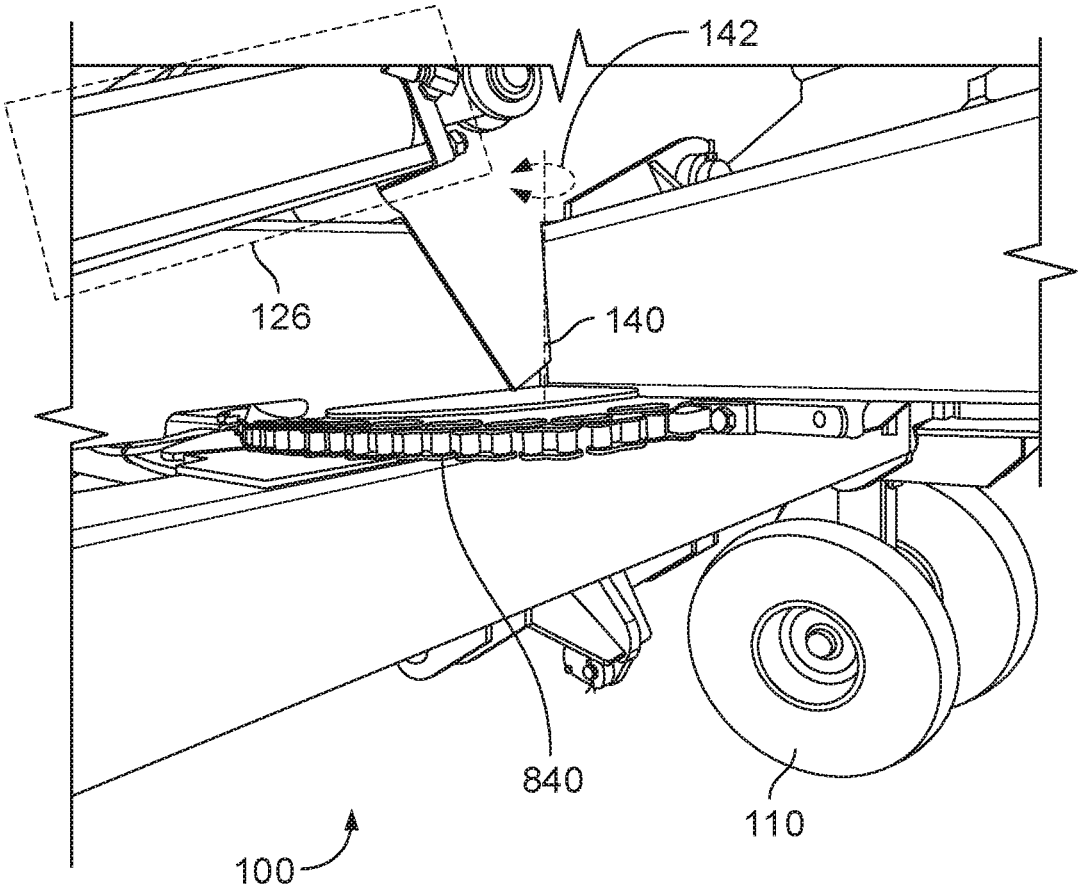
FIG. 8B is a rear perspective view of a rotation mechanism of a box blade.

FIG. 8B shows a rear perspective view of the rotating mechanism for the box blade 100, where the box blade 100 has assumed the same transportation configuration as in FIG. 8A. In some implementations, the chain drive 840 is oriented in a configuration resembling the arc of a circle, with its center aligned with axis 140. In the example shown, the chain drive 840 assumes the configuration of a 180 degree arc, although other configurations are possible. For example, the degree of the arc assumed by the chain drive 840 can be made smaller or larger depending on the degree of rotation required of the body of the box blade 100. Furthermore, the radius of the arc can also be adjusted to deliver more or less torque about the axis 140.

While the rotation mechanism shown is described having a single motor, gear, and chain drive, other configurations can be implemented. For example, the rotation mechanism can comprise one or more motors (e.g., a second motor), one or more gears (e.g., a second gear), one or more chain drives (e.g., a second chain drive). In one example, equipment can be symmetrically configured on the right side of the forwardly extending towing tongue 114. In some implementations, multiple gears and motors may be arranged to adjust the torque delivered about axis 140 to rotate the body of the box blade 100. In some implementations, the rotation mechanism may not include a chain drive at all, instead achieving equivalent performance with gears, spline teeth, or timing belts, or combinations of them, among others.

Figure 6A:
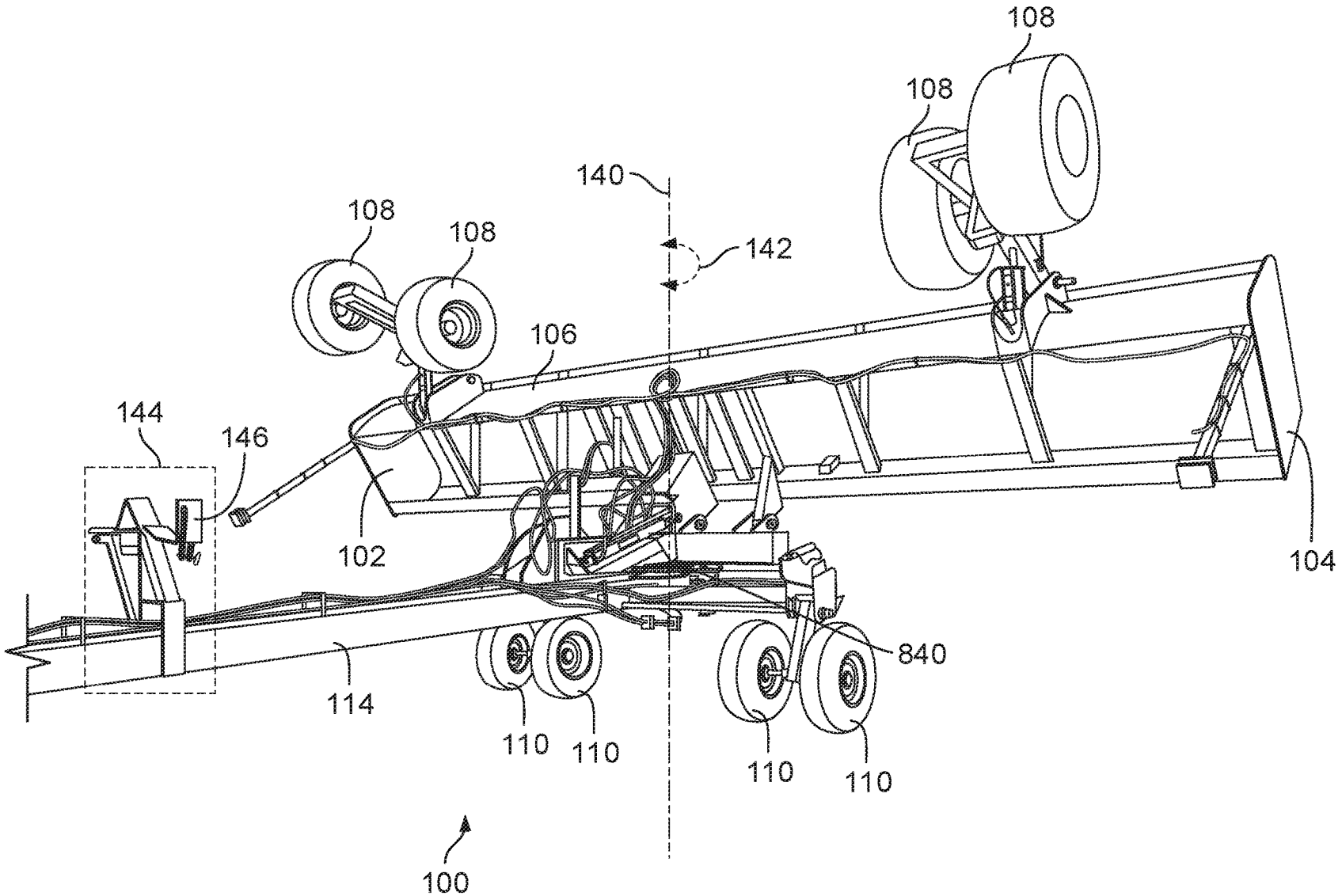
FIG. 6A is a perspective view of a box blade in an intermediate configuration.

Referring now to FIG. 6A, a perspective view of the reconfigurable box blade 100 is depicted, wherein the box blade 100 has assumed an intermediate configuration corresponding to the intermediate configuration shown in FIG. 5E. In addition to the components described above, FIG. 6A shows an optional stopping component 144 mounted to the forwardly extending towing tongue 114. The stopping component 144 may be shaped to receive the body of the box blade and prevent over-rotation of the body of the box blade about the rotation axis 140. However, various implementations may include other shapes or positions, or both, of the stopping component 144. In some cases, the stopping component 144 may include a latch 146 for securing the box blade in a transportation configuration. In some cases, the latch 146 may be implemented using a hinge joint. In some implementations, other fastening mechanisms, such as a clamp, a clasp, a clip, a bolt, a pin, a tie, a strap, or a flange, or combinations of them, among others, may be used in addition to or instead of the latch 146 to secure the box blade in the transportation configuration.

Figure 6B:
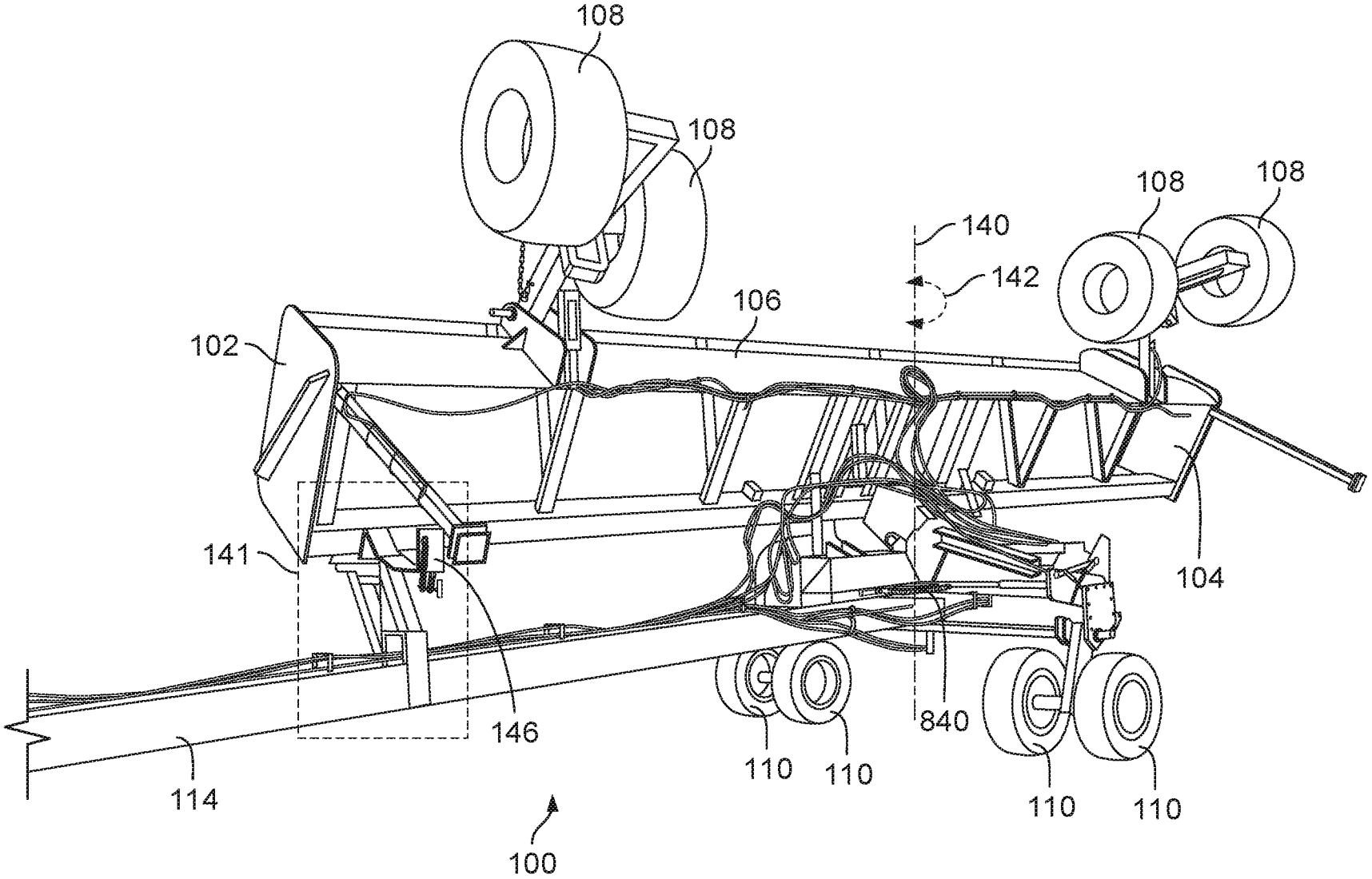
FIG. 6B is a perspective view of a box blade in an unsecured transportation configuration.

FIG. 6B shows a perspective view of the reconfigurable box blade 100 in a transportation configuration corresponding to the transportation configuration shown in FIG. 5F. In this example, the stopping component 144 is shaped to receive the body of the box blade and prevent over-rotation of the body of the box blade about the rotation axis 140. In this configuration, the latch 146 of the stopping component 144 has not been secured over the body of the box blade. Thus, this configuration may be referred to as an "unsecured" transportation configuration.

Figure 6C:
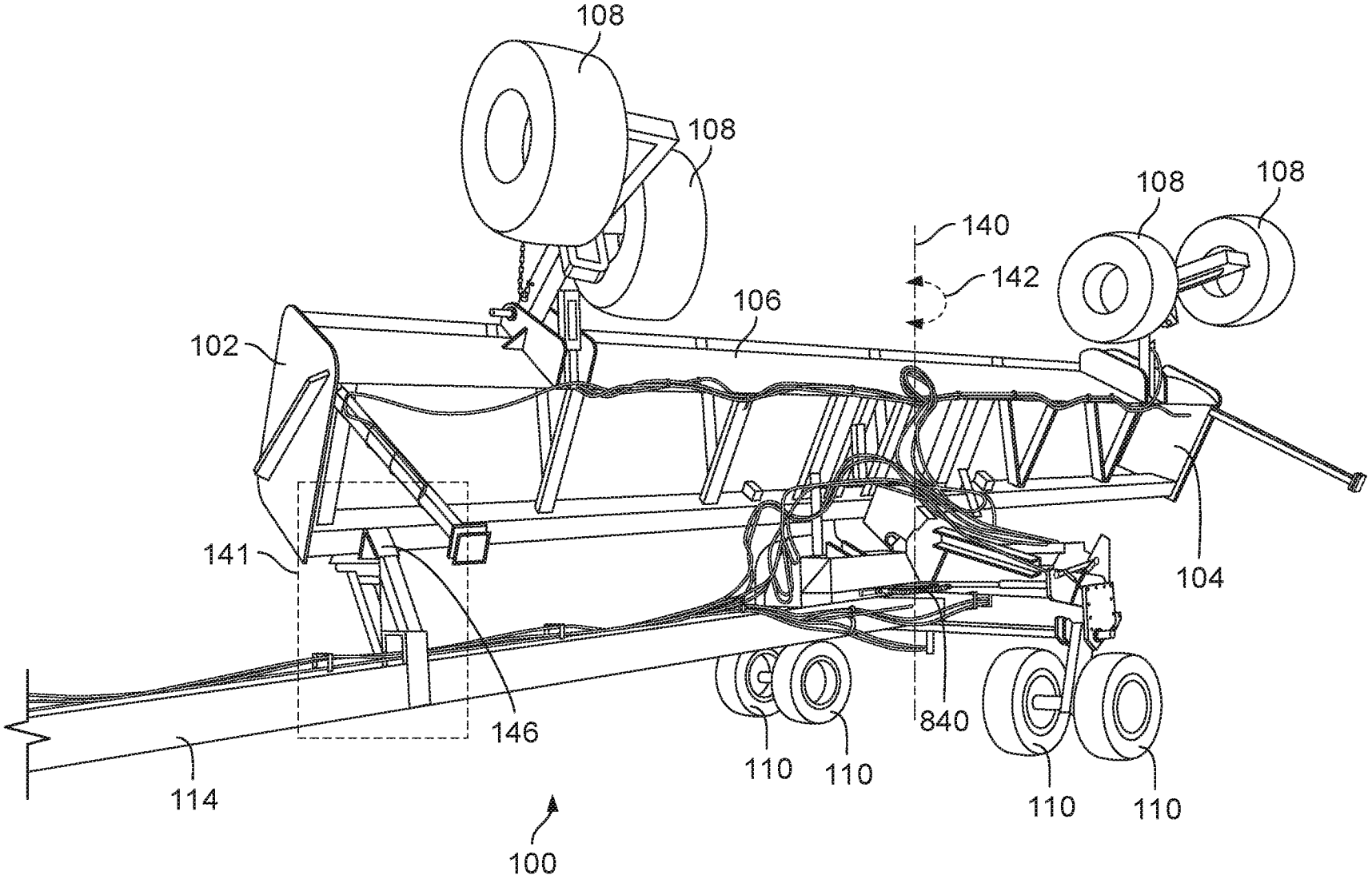
FIG. 6C is a perspective view of a box blade in a secured transportation configuration.

Referring now to FIG. 6C, a "secured" transportation configuration is shown in which the latch 146 of the stopping component 144 has been secured over the body of the box blade. In some cases, the latch 146 may be secured by tying the latch over the body of the box blade, inserting a pin to prevent rotation of the latch 146, including a locking mechanism to fix the latch 146 to the remainder of the stopping component 144, etc. In some cases, securing the latch 146 over the body of the box blade may provide additional stability and safety when transporting the box blade 100 from one location to another, for example, by preventing the box blade 100 from rotating about axis 140 into an undesired intermediate configuration.

Figure 7:
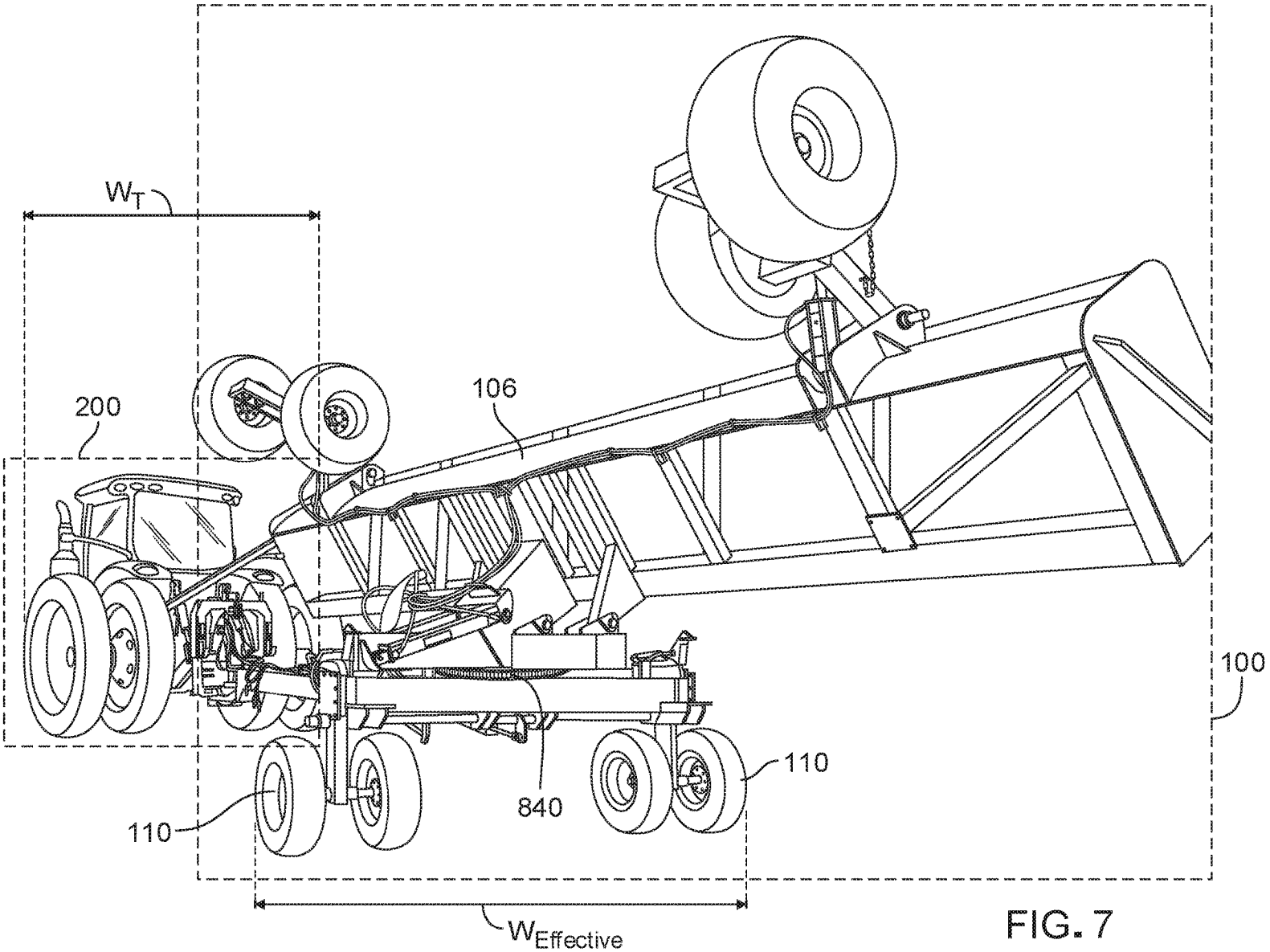
FIG. 7 is a rear perspective view of a box blade connected to a tractor in a transportation configuration.

FIG. 7 shows a rear perspective view of the reconfigurable box blade 100 connected to a tractor 200 in a transportation configuration. In the transportation configuration, the body of the box blade is lifted such that the scraping blade 106 is above the ground surface and does not make contact with the ground. Consequently, the transportation configuration enables the blade box 100 to be rolled from one location to another on front wheels 110 without performing unnecessary earth grading operations. Moreover, in the transportation configuration, the longest dimension, $W_{BB}$, of the reconfigurable blade box 100 is aligned with the forwardly extending towing tongue 114 and the longitudinal axis of the connected tractor 200. As a result, the effective width, $W_{Effective}$, of the reconfigurable blade box 100 in the transportation configuration may be much smaller than $W_{BB}$ (as described in relation to FIG. 2). In some cases, $W_{Effective}$ may be comparable in magnitude to the width, $W_T$, of the tractor 200, and in some cases, $W_{Effective}$, may be smaller than the typical width of a driving lane. This may enable the reconfigurable box blade 100 to be readily transported by the tractor 200, or any other connected vehicle, over most roadways.

A number of intermediate configurations and degrees of freedom of the reconfigurable box blade 100 have been described to demonstrate how the box blade 100 may be reconfigured from an operating configuration to a transportation configuration. These intermediate configurations are not intended to be limiting, and other implementations will be understood from the description provided. For example, by reversing the order of the configurations shown, the reconfigurable box blade 100 can be reconfigured from a transportation configuration to an operating configuration. In some cases, the order of the intermediate configurations and corresponding motions of the box blade 100 may be altered to achieve either similar or different configurations. Moreover, in some cases, a configuration described as an intermediate configuration for one transportation configuration may itself be considered a transportation configuration, in accordance with the definition of a transportation configuration provided above.

A number of embodiments have been described. Nevertheless, it will be understood that various modifications can be made without departing from the spirit and scope of the apparatus, systems, and techniques described herein. In addition, other components can be added to, or removed from, the described apparatus and systems. Accordingly, other embodiments are within the scope of the following claims.

What is claimed is:

1. A reconfigurable box blade comprising:

a box frame comprising a left sidewall, a right sidewall, a single scraping blade that spans laterally between the left sidewall and the right sidewall, wherein a bottom edge of the left sidewall is absent a scraping blade and a bottom edge of the right sidewall is absent a scraping blade, and one or more wheels, the one or more wheels being above a ground surface when the reconfigurable box blade is in a stowed configuration, and the one or more wheels being in contact with the ground surface and located aft the single scraping blade when the reconfigurable box blade is in a deployed configuration, and a connecting structure configured to attach the box frame to a vehicle, wherein the deployed configuration comprises a first dimension of the box frame oriented substantially perpendicular to a longitudinal axis of the vehicle, wherein the stowed configuration comprises the first dimension of the box frame being substantially aligned with the longitudinal axis of the vehicle, and wherein the reconfigurable box blade is rotatable about a rotation axis and a wheel axis for reconfiguring from the stowed configuration to the deployed configuration and for reconfiguring from the deployed configuration to the stowed configuration, wherein the rotation axis is orthogonal to the wheel axis.

2. The reconfigurable box blade of claim 1, wherein the first dimension of the box frame is a longest dimension of the box frame.

3. The reconfigurable box blade of claim 1, wherein the connecting structure configured to attach the box frame to the vehicle comprises a forwardly extending towing tongue.

4. The reconfigurable box blade of claim 1, wherein the connecting structure configured to attach the box frame comprises a mount configured to interface with one or more three point hitch arms of the vehicle.

5. The reconfigurable box blade of claim 1, further comprising one or more devices configured to loosen soil, the one or more devices mounted to the box frame.

6. The reconfigurable box blade of claim 1, further comprising one or more devices configured to collect data indicative of a grading operation of the box blade.

7. The reconfigurable box blade of claim 1, wherein the deployed configuration further comprises a subset of the one or more wheels being out of contact with a ground surface and the stowed configuration further comprises the subset of the one or more wheels being in contact with the ground surface.

8. The reconfigurable box blade of claim 1, wherein the wheel axis of is configured to move relative to the box frame.

9. The reconfigurable box blade of claim 8, further comprising a linear motion actuator configured to move the wheel axis.

10. The reconfigurable box blade of claim 1, wherein the box frame is configured to be raised and lowered relative to the ground surface.

11. The reconfigurable box blade of claim 10, wherein raising the box frame relative to the ground surface comprises rotating the box frame beyond 90 degrees relative to the ground surface.

12. The reconfigurable box blade of claim 10, wherein subsequent to being raised relative to the ground surface, the box frame is further configured to be rotated about the rotation axis oriented perpendicular to the ground surface.

13. The reconfigurable box blade of claim 12, further comprising one or more gears and a chain drive configured to rotate the box frame.

14. The reconfigurable box blade of claim 1, wherein reconfiguring the box blade from the deployed configuration to the stowed configuration comprises:

moving, relative to the box frame, the wheel axis;

raising the box frame relative to the ground surface; and rotating the box frame about the rotation axis oriented perpendicular to the ground surface.

15. The reconfigurable box blade of claim 1, further comprising a stopping component mounted to the connecting structure, the stopping component configured to secure the box blade in the stowed configuration.

16. The reconfigurable box blade of claim 15, wherein the stopping component comprises a latch configured to be secured over a portion of the box frame.

17. A method of reconfiguring a box blade attached to a vehicle, comprising:

from a first configuration, raising, relative to a ground surface, a box frame of the reconfigurable box blade, the box frame comprising a left sidewall, a right sidewall, and a single scraping blade that spans laterally between the left sidewall and the right sidewall, wherein a bottom edge of the left sidewall is absent a scraping blade and a bottom edge of the right sidewall is absent a scraping blade, and the first configuration comprises a first dimension of the box frame being oriented substantially perpendicular to a longitudinal axis of the vehicle, wherein the reconfigurable box blade comprises one or more wheels, the one or more wheels being in contact with the ground surface and located aft the single scraping blade when the reconfigurable box blade is in the first configuration; and rotating the box frame about a rotation axis oriented perpendicular to the ground surface into the second configuration, the second configuration comprising the first dimension of the box frame being substantially aligned along the longitudinal axis of the vehicle, the one or more wheels being above the ground surface when the reconfigurable box blade is in the second configuration, and wherein the reconfigurable box blade is rotatable about a rotation axis and a wheel axis for reconfiguring from the second configuration to the first configuration and for reconfiguring from the first configuration to the second configuration, wherein the rotation axis is orthogonal to the wheel axis.

18. The method of claim 17, wherein raising the box frame relative to the ground surface comprises moving, relative to the box frame, the wheel axis.

19. The method of claim 18, wherein the wheel axis is moved such that the one or more wheels of the box blade contacts the ground surface and the scraping blade is raised above the ground surface such that the scraping blade is out of contact with the ground.

20. The method claim 18, wherein the wheel axis is moved by a linear motion actuator.

21. The method of claim 17, wherein raising the box frame relative to the ground surface comprises rotating the box frame beyond 90 degrees relative to the ground surface.

22. The method of claim 17, wherein the box frame is raised by a linear motion actuator.

23. The method of claim 17, wherein the box frame is rotated by a rotation mechanism comprising one or more gears and a chain drive.

24. The method of claim 17, further comprising:

stopping rotation of the box frame when the box frame comes in contact with a stopping component of the box blade.

25. The method of claim 17, further comprising:

securing the box blade in the second configuration using a latch, the latch configured to be secured over a portion of the box frame.

26. A reconfigurable box blade comprising:

a box frame comprising a left sidewall, a right sidewall having at least one length equivalent to at least one length of the left sidewall, a single scraping blade that continuously spans laterally between the left sidewall and the right sidewall wherein a bottom edge of the left sidewall is absent a scraping blade and a bottom edge of the right sidewall is absent a scraping blade; and one or more wheels, wherein the one or more wheels are above a ground surface when the reconfigurable box blade is in a stowed configuration, and wherein the one or more wheels are in contact the with the ground surface and located aft the single scraping blade when the reconfigurable box blade is in a deployed configuration;

a connecting structure configured to attach the box frame to a vehicle; and a stopping component mounted to the connecting structure, the stopping component configured to secure the box blade in the stowed configuration, the stopping component comprising a latch configured to be secured over a portion of the box frame;

wherein a first dimension of the box frame is oriented substantially perpendicular to a longitudinal axis of the vehicle when the reconfigurable box blade is in the deployed configuration, wherein the first dimension of the box frame is substantially aligned with the longitudinal axis of the vehicle when the reconfigurable box blade is in the stowed configuration, and wherein a wheel axis of one or more wheels of the box blade is moved relative to the box frame as the box frame is raised relative to the ground surface, the box frame is rotated about a rotation axis perpendicular to the ground surface to move the box frame from the deployed configuration to the stowed configuration, and wherein the box frame is rotated 90 degrees relative to the ground surface and rotated about the rotation axis perpendicular to the ground surface from the stowed configuration to the deployed configuration.

27. The reconfigurable box blade of claim 26, wherein the first dimension of the box frame is at least 20 feet.

28. The reconfigurable box blade of claim 26, wherein a flat surface of the stopping component contacts a flat surface of the box frame when the box frame is rotated beyond 90 degrees about the rotation axis oriented parallel to the ground surface and the box frame is rotated about the rotation axis perpendicular to the ground surface to move the box frame into the stowed configuration.

* * * * *